United States Patent [19]

Corbett

[11] Patent Number: 4,521,154

[45] Date of Patent: Jun. 4, 1985

[54] CENTRIFUGAL FANS

[76] Inventor: Reg D. Corbett, 30103 Clemens Rd., Westlake, Ohio 44145

[21] Appl. No.: 339,029

[22] Filed: Jan. 13, 1982

[51] Int. Cl.[3] ..... F01D 5/14

[52] U.S. Cl. ..... 416/175; 416/182; 415/212 R

[58] Field of Search ..... 416/179, 181, 182, 183, 416/175, 189, 227 R, 186 R; 415/212, 211, 217

[56] References Cited

U.S. PATENT DOCUMENTS

| | | | |
|---|---|---|---|
| 171,872 | 1/1876 | Schwenzfeier | 416/182 |
| 195,855 | 10/1877 | Stilwell | 416/175 |
| 713,990 | 11/1902 | Keith | 416/175 |
| 1,150,278 | 8/1915 | Lepley | 416/183 |
| 1,331,071 | 2/1920 | Leonard | 416/182 |
| 2,589,558 | 3/1952 | Lamoreaux | 416/182 X |
| 2,609,142 | 9/1952 | Wirz | 416/183 |
| 3,124,200 | 3/1964 | Wilson | 416/179 |
| 3,201,032 | 8/1965 | Gelbard | 416/175 |
| 3,260,443 | 7/1966 | Garnett et al. | 416/182 |
| 3,572,967 | 3/1971 | Schreter et al. | 416/185 |
| 3,669,563 | 6/1972 | Corbett, Jr. | 416/185 X |
| 3,904,308 | 9/1975 | Ribaub | 416/183 X |
| 4,195,473 | 4/1980 | Aspinwall | 416/183 X |
| 4,355,945 | 10/1982 | Wilson | 416/183 X |

FOREIGN PATENT DOCUMENTS

| | | | |
|---|---|---|---|
| 24794 | of 1910 | United Kingdom | 416/179 |

*Primary Examiner*—Philip R. Coe
*Assistant Examiner*—Frankie L. Stinson
*Attorney, Agent, or Firm*—J. Helen Slough

[57] ABSTRACT

A circulating fan for annealing furnaces of the type having a centrally apertured circular base plate, a plurality of circumferentially spaced radially disposed main fan blades, mounted on one side of said base plate having a forwardly inclined concave scoop portion, one or more interceptor blades inclined in the same direction as the scoop and disposed between a pair of adjacent said main fan blades. A circular flat outer upper peripheral ring to which said main and interceptor blades are secured.

4 Claims, 4 Drawing Figures

CENTRIFUGAL FANS

My invention relates to improvements in centrifugal fans and relates more particularly to centrifugal fans for circulating atmosphere gas for either heating or cooling purposes in an annealing furnace as set forth, described, and claimed in U.S. Pat. No. 3,669,563 granted June 13, 1972.

In the circulating centrifugal fan structure of the prior patent, the fan comprised a circular base plate having a central aperture and a plurality of circumferentially spaced fan blades mounted on one side of said base plate and radiating outwardly from a central hub. In said structure each blade is formed by a pair of upwardly converging walls and comprises a main blade portion on the front side of the blade which provides a leading surface with respect to the rotation of the fan and an auxiliary blade support portion disposed on the front side of the main blade and which provides a trailing surface therefor. The blade forms a forwardly concave elongated scoop along the distal edge of each blade and fluid is directed away from the base plate and into said scoop thereby.

The present invention is directed to improvements in the efficiency of such fans and achieves the same by addition of improved means for increasing the suction or scooping effect of the rotary curved blades of the aforesaid patent.

Further improvements in such fans are also achieved by the present invention, such as improvements in the structural stability of the fans, and an increase in the over-all greater efficiency of the fan related to its size and R.P.M.

A still further object is to provide an improvement in fans of the type described which will adapt the same for particular application where a relatively small orifice is provided in the intake area of the fan and enable the same to achieve greater flow and increased over-all efficiency.

Still other objects of the invention itself will become more readily apparent from a purview of the accompanying description and the appended drawings, in which drawings.

Figure 1:
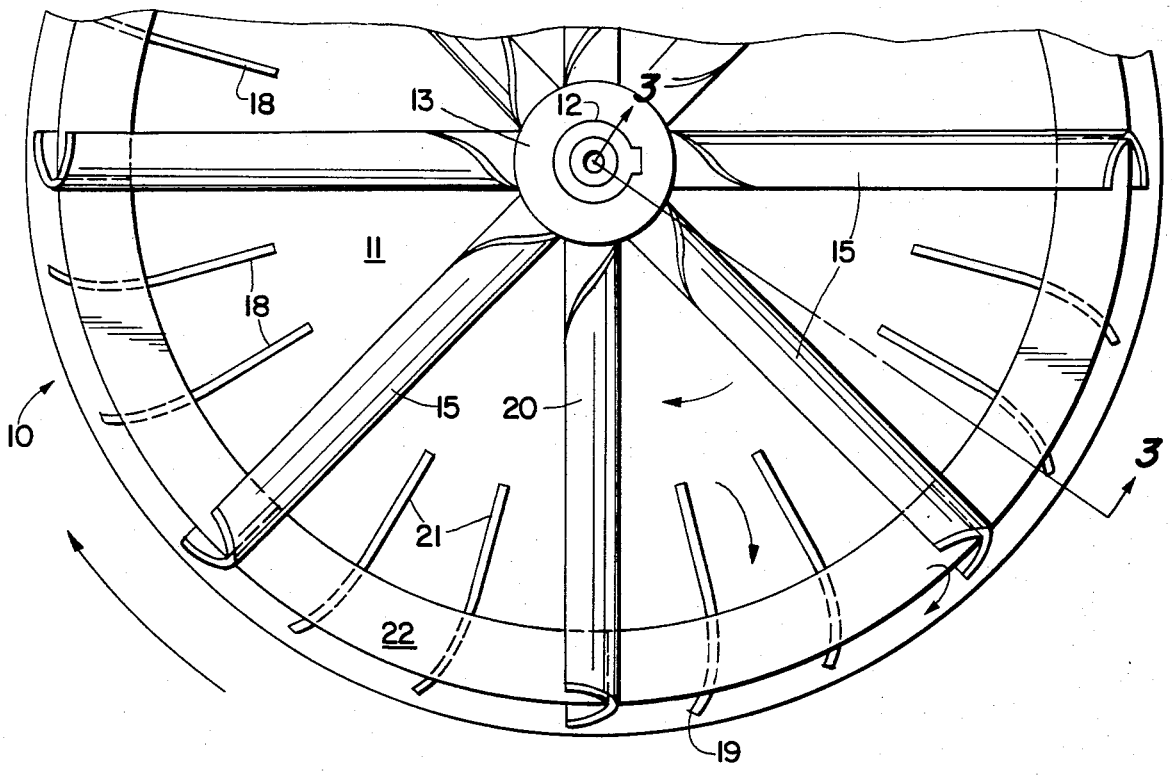
FIG. 1 is a fragmentary top plan view of the fan of an embodiment of the invention.

Referring now to the drawings, in all of which like parts are designated by like reference numerals, the centrifugal fan 10 of my invention comprises a circular base plate 11 having a central aperture 12 therein, a hub 13 being secured to the upper surface of the base plate coaxially with said aperture as in U.S. Pat. No. 3,669,563 referred to hereinabove. As best seen in FIG. 1 the centrifugal fan 10 is provided with a plurality of fan blades 15 welded or otherwise suitably secured to the upper surface of the circular base 11 which blades are radially disposed outwardly from the central hub 13. Each fan blade is formed by a pair of upwardly converging walls and comprises a main blade portion 16 and an auxiliary blade support portion 17. The main blade portion 16 is disposed on the front side of the blade and provides a leading surface with respect to the rotation of the fans, as shown by arrows in FIG. 1, whereas the blade support portion 17 of each blade provides substantially the trailing surface of each blade, a portion of the main blade portion projecting upwardly and forwardly therefrom.

As shown in FIGS. 1, 2, 3 and 4, a spaced bucket member or members 18 or spaced intermediate relatively short interceptor blade or blades 18 of uniform height are mounted on the circular base plate 11, each of said members or blades having a straight vertically disposed rear edge 19 at its distal portin and a forwardly inwardly projecting inclined portion 21. The forward portion 21 of the member 18 is inclined in the direction of the forwardly concave curved elongated scoop 20 of the blades 15 and a member or pair of members 18 are disposed in equally spaced relation to a pair of spaced fan blades 15—15. The intermediate members 18 are of relatively lesser height and length than the main blades and in use increase the suction or venturi effect of the curved main fan blades. During operation of the fan, fluid or air is scooped up by a main blade 15 and the velocity of such movement is increased by the suction or pumping effect of the so-called buckets.

A circular flat end ring member 22 which as shown is formed by a plurality of semi-circular ring pieces is secured, as by welding, to the upper flat surfaces 23 of the interceptor blades 18 and to the curved scoop portion of the main blades 15, as by weldments or the like. The flat ring member 22 forms the upper outer periphery of the fan and a support therefor. The main blades project through segments of the ring 22 at equally spaced portions of the ring and the interceptor blades are covered at their upper surfaces thereby. The main and interceptor blades thus are secured to both the lower base plate and the upper end ring.

Figure 2:
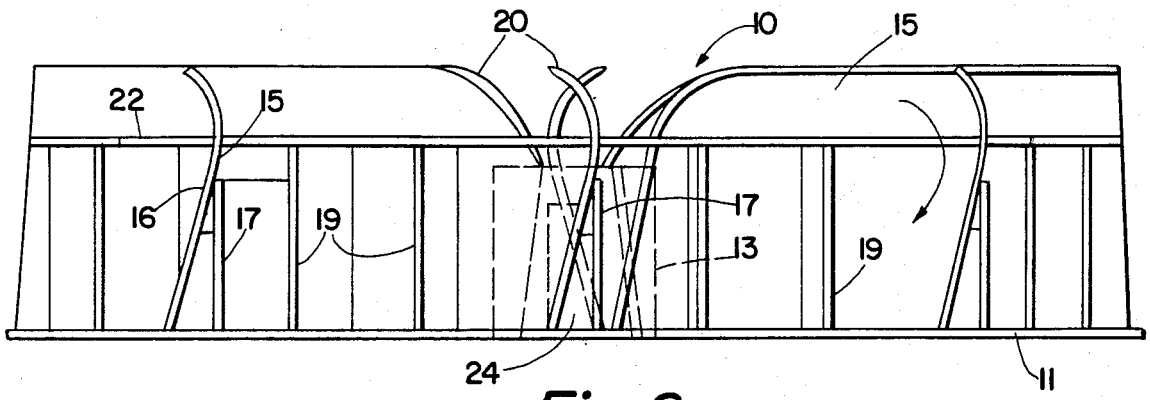
FIG. 2 is a side elevational view of the invention of FIG. 1.
Figure 3:
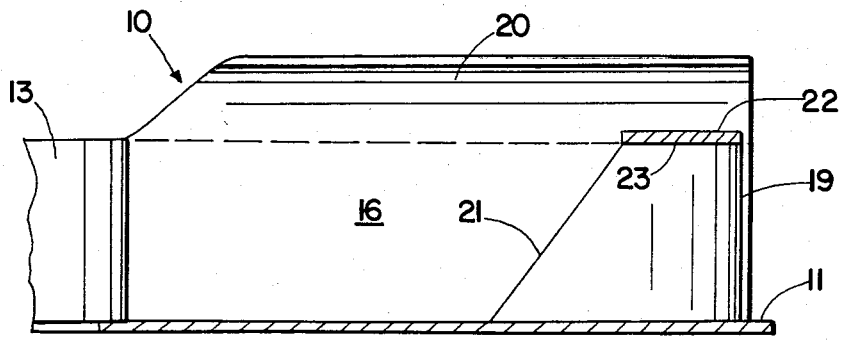
FIG. 3 is a still further elevational view of one fan blade showing a leading face thereof and additional suction means taken along the line 3—3 of FIG. 1.
Figure 4:
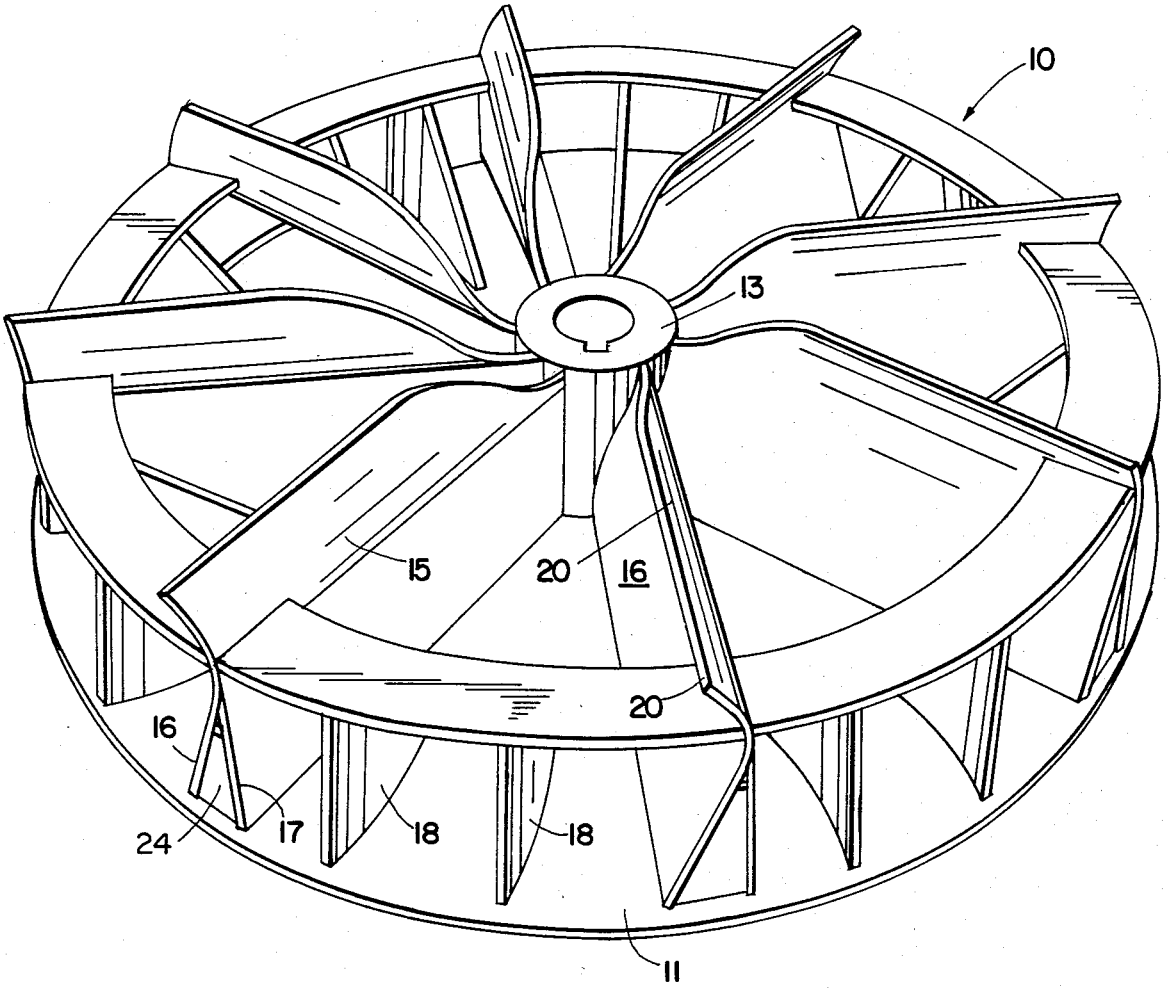
FIG. 4 is a perspective view of the fan of FIGS. 1 to 3, inclusive.

It is to be noted that the main blades 15 are gusseted together by a connection plate shown at 24, FIG. 2, welded to the converging walls of the main blade portion 16 and the auxiliary blade support 17.

It is to be noted that the improved fan of the present invention provides outer interceptor blades of lesser height than the generally rotary radially extending main blades which are similar to those in U.S. Pat. No. 3,669,563 and said interceptor blades are in spaced relation between a spaced pair of said main blades to increase the suction effect on the said rotary curved blades. The main blades and said outer interceptor blades are mounted on a base plate and secured adjacent their upper surfaces by an outer ring member, the scoop portion of the main blade extends above and inwardly beyond the ring member and the inclined portion of the interceptor blades extends beyond the periphery of the ring member and inwardly toward the inner periphery of the base plate.

While I have described my invention in connection with a preferred embodiment, it is to be understood that numerous and extensive departures may be made therefrom without however departing from the spirit of my invention or the scope of the appended claims.

What I claim is:

1. A centrifugal fan comprising a centrally apertured circular metal base plate, a central hub secured to the upper surface of the base plate coaxially with the aperture, a plurality of circumferentially spaced main blades mounted on one side of said base plate, each blade extending substantially radially with respect to said hub and comprising a pair of converging walls projecting from the upper surface of the base plate whereby each blade is of inverted V-shape in cross-section, one of the walls providing a leading surface and the other wall providing a trailing surface with respect to the intended direction of rotation of said fan, each blade having a blade extension extending upwardly from the line of convergence of said walls, one of said walls forming main blade portions and one of said walls forming an auxiliary blade support, said extension being curved forwardly with respect to the direction of rotation of said fan to form an elongated scoop along the distal edge of each blade, at least one relatively short blade of lesser height then said main blade being mounted on the outer peripheral side of the base plate on which the main blades are mounted and disposed in equally spaced relation between a pair of adjacent said main blades, which relatively short blade has a curved portion inclined in the direction of the curve of the leading edge of the extension of the main blade forming the scoop, and in which a relatively circular flat outer ring member is disposed over a flat upper surface of said relatively short blade forming the upper outer periphery of said fan and the inclined portion of said blade extends beyond the inner periphery of the ring member.

2. A fan as claimed in claim 1, wherein the rear portion of the scoop or curved portion of said main blades is disposed above said circular ring.

3. A fan as claimed in claim 1, wherein said circular flat ring member is comprised of a plurality of segments.

4. A fan as claimed in claim 1, wherein said main blades and said relatively short blades are secured to both the lower base plate and the circular ring and supported thereby.

* * * * *